US007036279B2

(12) United States Patent
Crozzoli

(10) Patent No.: US 7,036,279 B2
(45) Date of Patent: May 2, 2006

(54) FULLY PREFABRICATED STEEL ARMORED BLIND

(76) Inventor: Gualtiero Crozzoli, Via dei Corsi, 1 00040 Rocca di Papa, Rome (IT)

( * ) Notice: Subject to any disclaimer, the term of this patent is extended or adjusted under 35 U.S.C. 154(b) by 94 days.

(21) Appl. No.: 10/418,432

(22) Filed: Apr. 17, 2003

(65) Prior Publication Data

US 2004/0010972 A1 Jan. 22, 2004

(30) Foreign Application Priority Data

Apr. 17, 2002 (IT) ..... 2002A000214

(51) Int. Cl.
*E06B 1/04* (2006.01)

(52) U.S. Cl. ..... 52/213; 52/204.1; 52/473; 52/202

(58) Field of Classification Search ..... 52/202, 52/473, 204.1, 205, 206, 210–213, 215, 204.5, 52/208; 49/74.1–92.1, 504
See application file for complete search history.

(56) References Cited

U.S. PATENT DOCUMENTS

| | | | | | |
|---|---|---|---|---|---|
| 1,613,017 | A | * | 1/1927 | Nuss | 52/204.53 |
| 2,067,403 | A | * | 1/1937 | Lea | 52/481.1 |
| 2,068,276 | A | * | 1/1937 | Mack | 66/127 |
| 2,939,185 | A | * | 6/1960 | Ader et al. | 49/380 |
| 3,254,464 | A | * | 6/1966 | Hoyt, Jr. | 52/309.9 |
| 3,350,123 | A | * | 10/1967 | Loving et al. | 403/188 |
| 3,403,486 | A | * | 10/1968 | Emanuel | 52/127.2 |
| 3,443,346 | A | * | 5/1969 | Eggert, Jr. | 52/214 |
| 3,653,317 | A | | 4/1972 | Costanzo, Jr. | 98/110 |
| 3,987,596 | A | * | 10/1976 | Wolf | 52/196 |
| 3,992,833 | A | * | 11/1976 | Hulinsky | 52/206 |
| 4,335,550 | A | * | 6/1982 | Johnson | 52/99 |
| 4,939,880 | A | | 7/1990 | Wang | 52/473 |
| 5,152,116 | A | | 10/1992 | MacGowan | 52/473 |
| 5,255,486 | A | | 10/1993 | Wang | 52/473 |
| 5,634,998 | A | | 6/1997 | Schiedegger et al. | 156/73.1 |
| 5,761,860 | A | | 6/1998 | Koike et al. | 52/204.67 |
| 5,787,642 | A | | 8/1998 | Coyle et al. | 49/61 |
| 6,079,181 | A | * | 6/2000 | Ruff | 52/745.15 |
| 6,148,572 | A | * | 11/2000 | Ruff | 52/204.1 |
| 6,543,188 | B1 | * | 4/2003 | Poma et al. | 52/78 |
| 6,651,390 | B1 | * | 11/2003 | Camperelli | 49/504 |
| 6,722,089 | B1 | * | 4/2004 | Budzinski | 52/204.5 |

FOREIGN PATENT DOCUMENTS

| | | |
|---|---|---|
| DE | 19726908 | 1/1999 |
| FR | 2749877 | 12/1997 |
| IT | 218144 | 7/1989 |
| IT | 1275105 | 7/1997 |

OTHER PUBLICATIONS

PCT Search Report for PCT/IB 03/01474, International Filing Date Apr. 17, 2003.

* cited by examiner

*Primary Examiner*—Jeanette E. Chapman
(74) *Attorney, Agent, or Firm*—Dobrusin & Thenisch PC

(57) ABSTRACT

The subject of the invention is directed toward a blind assembly having a pair of vertical elements. The vertical elements each have a top and bottom and a plurality of slots formed therein. An upper transverse element engages the tops of the vertical elements and a lower transverse element similarly engages the bottoms of the vertical elements. A plurality of slats engage the slots of the vertical elements and extend substantially parallel with the upper and lower transverse elements. A mounting arrangement interlocks the upper transverse element to the tops of the vertical elements, the lower transverse element to the bottoms of the vertical elements, and the slats to the vertical elements for eliminating the need to weld the blind assembly.

18 Claims, 12 Drawing Sheets

FULLY PREFABRICATED STEEL ARMORED BLIND

RELATED APPLICATION

The subject patent application claims priority to and the benefits of co-pending Italian Patent Application, serial no. 2002A000214, which was filed on Apr. 17, 2002.

PRIOR ART

As shown in FIGS. 1–3, traditional steel blinds employ commercial profiles (AA) provided with slots to receive slats. (See FIG. 1). Such blinds are cut, assembled, welded, and finished with lapping machines. The profile includes wing posts where the upper part is cut at 45°, while in the bottom part it is cut at 90° (see FIG. 2).

During the last twenty years, the above system has not changed, because it reached an optimum compromise between the need of employing fixed pitch slotted elements and providing the use of the variable terminal. The variable terminal, when used in the bottom part of the casing, completes a gap (D) created by the use of the slots in the wing post and any discrepancy in dimensions between the counterframe and the blind. Said solution was positively introduced by the applicant with the Italian Patent No. 0218144.

However, the above solution provided assembling by welding followed by grinding (in other words, there are two "C" shaped profiles, each slidable with respect to each other, conforming with the profile (A) to the last usable slot (U) and with the profile (B) to the base end. Industry manufacturing fixed pitch slot blinds has not been able to depart from the wing's welding. This is true both in the upper part, coupled at 45°, and in the bottom part coupled at 90° to the variable terminal.

The system providing the use of anchorage square elements for the steel has been a failure because the steel manufacturing methods, since this method derived from the constructing system for aluminum casings. This is illustrated in the colossal difference existing between the well gauged extrusion products (aluminum) and the low precision profiled product (steel), the steel being characterized by infinite size variations, even within sections of the same lot. Thus, the square element followed the profile imperfections creating some minimal gaps and clearances, not compatible with a skillful structure.

The object of the inventor is allowing the manufacture of steel blinds without traditional welding, and leaving a galvanizing film intact in the contact points; and further reducing the execution times even up to 80%.

SUMMARY OF THE INVENTION

The system "Advanced Siver" realizes the aforementioned advantages by providing a wing coupling system that possesses the toughness required by the user. By this innovation it is desired to create a prefabricated product, such as a kit, ready to be assembled by the client, already painted, because the "Advanced Siver" system does not damage the preliminary painting in the final assembling phase.

The blind comprises five embodiments that illustrate every kind of blinds that could be required in the market, two of the profiles function as a chassis, and the three others are employed for the wings.

A basic characteristic is that the wings are rigorously cut and assembled at 90° angles using particular arrangements of absolute toughness; so, it is possible to realize an effective armor plating without employing expensive welded, ground, or adjusted structures.

All the accessories are assembled with as much care and attention as the market demands; that is absolute inaccessibility to penetrating forces. The measures of the wing's height cut has a fixed pitch corresponding to the slot pitch, the other variations with respect to the real measure of the light gap are compensated in the upper traverse element employing the adjustable butterfly support.

It is believed that this innovation could be the subject matter of an industrial invention patent, solving many problems by modifying the profiles, the accessories, and the working mode.

In particular, the invention is directed toward a blind assembly comprising a pair of vertical elements each having a top and bottom and a plurality of slots formed therein. An upper transverse element engages the tops of the vertical elements. A lower transverse element similarly engages the bottoms of the vertical elements. A plurality of slats engage the slots of the vertical elements and extend substantially parallel with the upper and lower transverse elements. A mounting arrangement interlocks the upper transverse element to the tops of the vertical elements, the lower transverse element to the bottoms of the vertical elements, and the slats to the vertical elements for eliminating the need to weld the blind assembly.

DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
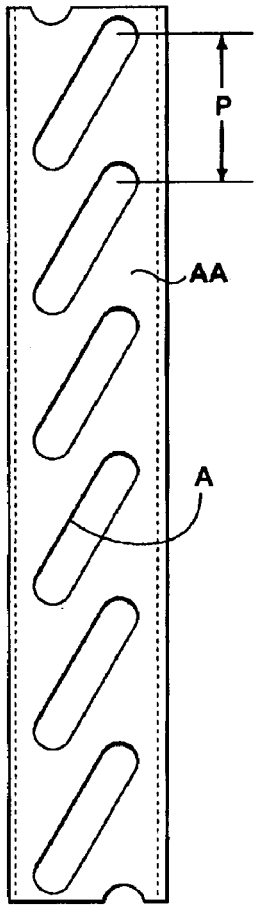
FIG - 1 PRIOR ART
FIG. 1 is a interior view of a vertical support element of the prior art.
Figure 2:
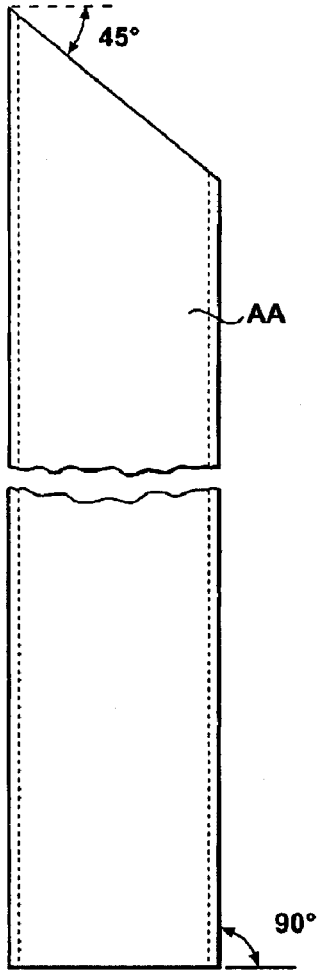
FIG - 2 PRIOR ART
FIG. 2 is a fragmented side view of the vertical support element of the prior art.
Figure 3:
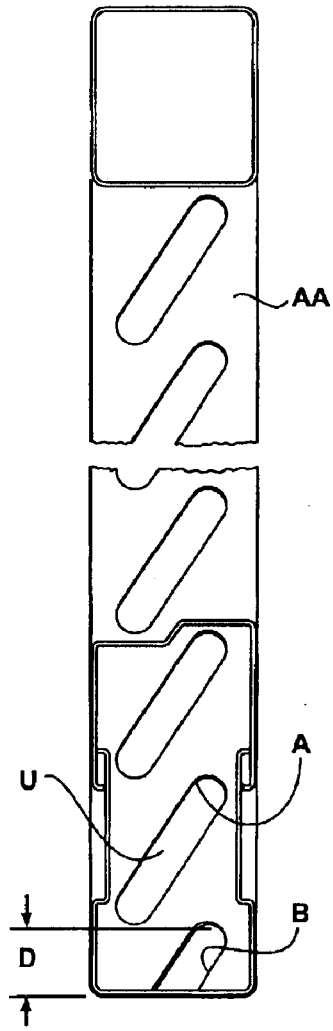
FIG - 3 PRIOR ART
FIG. 3 is a fragmented interior view of the vertical support element of the prior art.
Figure 4:
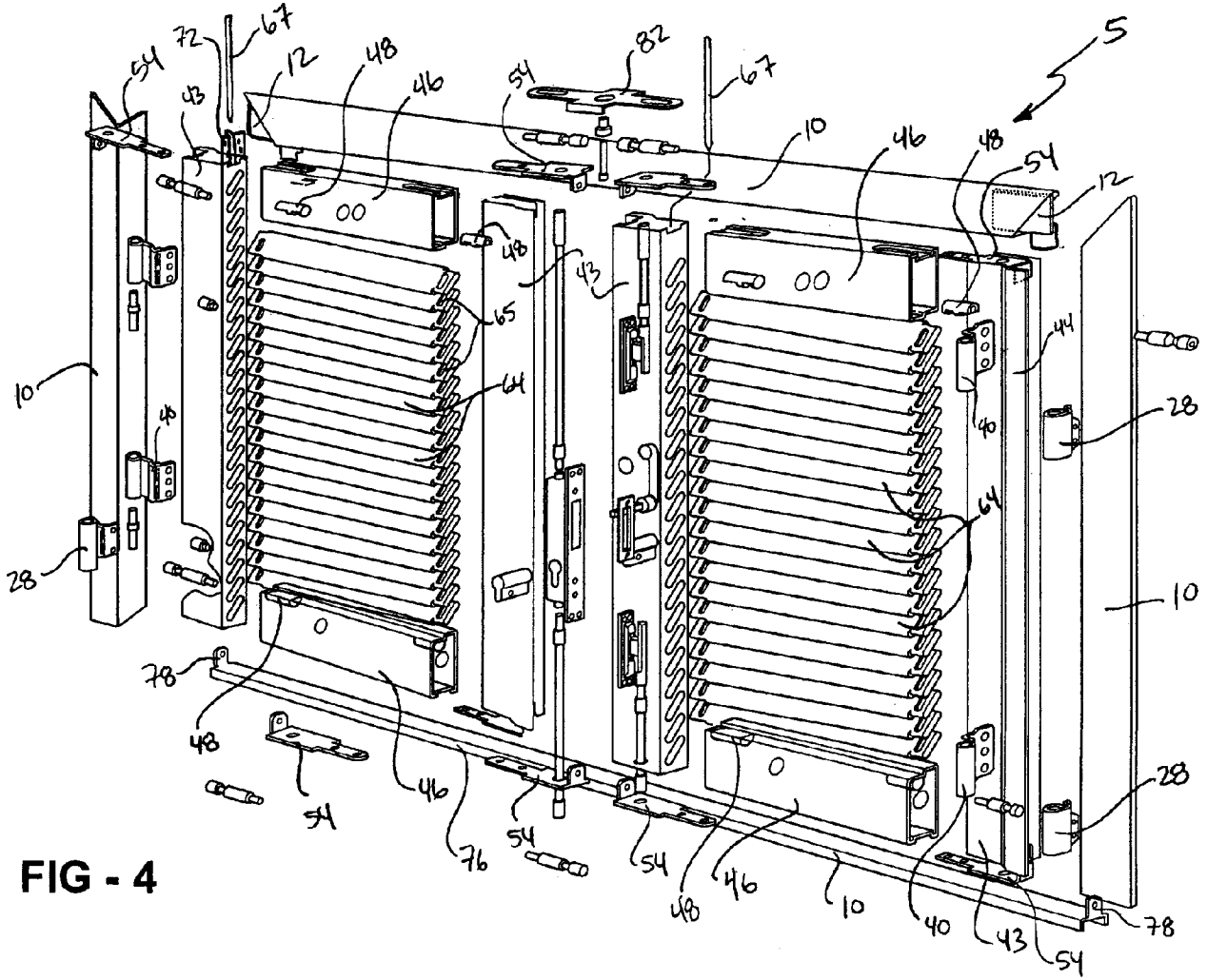
FIG. 4 is a perspective view of a blind assembly in accordance with the subject invention.
Figure 5:
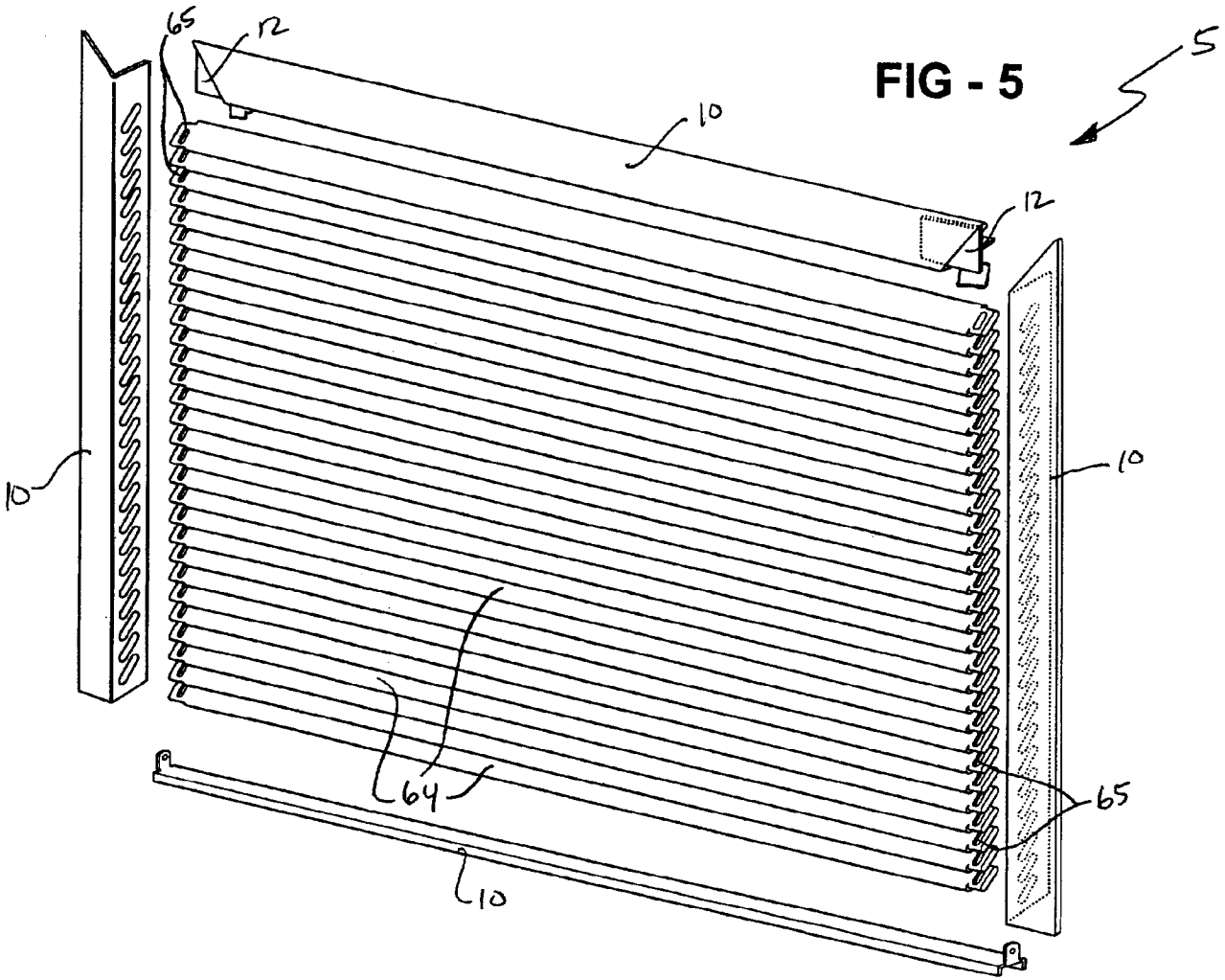
FIG. 5 is a perspective view of an alternative embodiment of the blind assembly.

A blind assembly 5 in accordance with the invention is generally shown in FIG. 4. The blind assembly 5 has two wing sections. For illustrative purposes, only one of the wing sections is discussed in greater detail below. FIG. 5 illustrates an alternative embodiment of the blind assembly, which is discussed in greater detail below.

The frame system is comprised of a shaped profile, said shape being necessary to enable the use of the fittings, such as hinges, pressure elements, square elements, "bifort supports", seat protections, and deformations.

Figure 6:
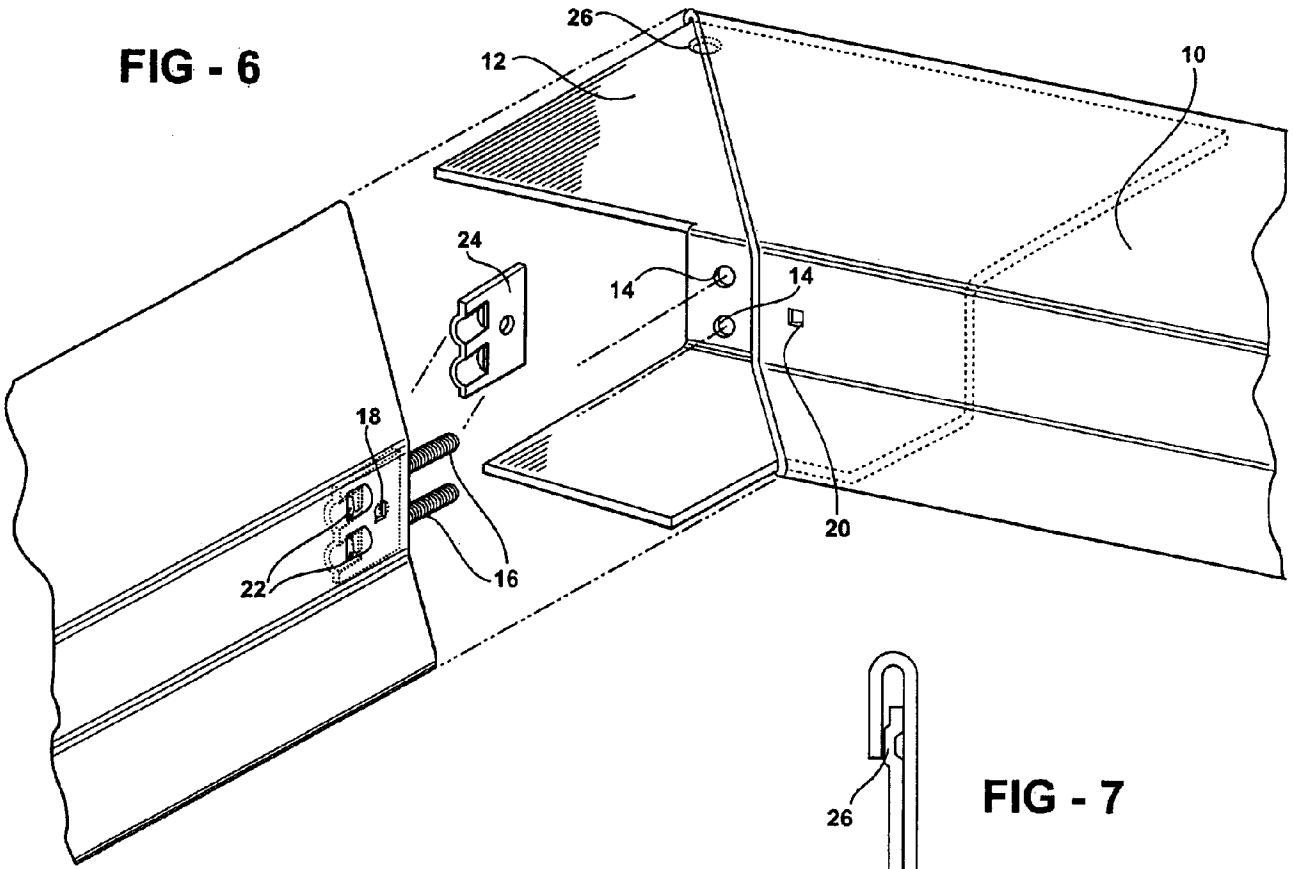
FIG. 6 is an exploded perspective view of a frame in accordance with the subject invention.

FIG. 6 shows a corner of the profile, with the square element inserted in position.

Profile of the frame 10 of FIG. 6, is cut at 45°, coupled with the particular double tie rod system. In this system, a square element 12 is inserted within the upper transverse portion, into the two ends already cut at 45°. The square element 12 has two round holes 14, that will receive tie rods 16 and a square hole 18 corresponding to a square hole 20 on the frame 10, allowing its integral coupling. Employing a bolt (not shown), having an oval head and a square base, in FIG. 6, the position can be seen that will receive two tie rods 16; said tie rods 16 will be restrained by the bolt head within rectangular seats 22, to be secured there by a shaped base 24.

The base 24 is tightened by a bolt sliding within the square seat of the frames 10 and of the round hole base.

Figure 7:
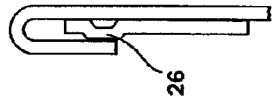
FIG. 7 is a fragmented side view of a portion of the frame.

The square element 12 represents a reinforcing element of the corner. As shown in FIG. 7, it is inserted between the bent sheet parts in such a way to form a perfect restraint plane. Abutment 26 creates a forced point in the profile bend, thus eliminating mechanical clearances.

Figure 8:
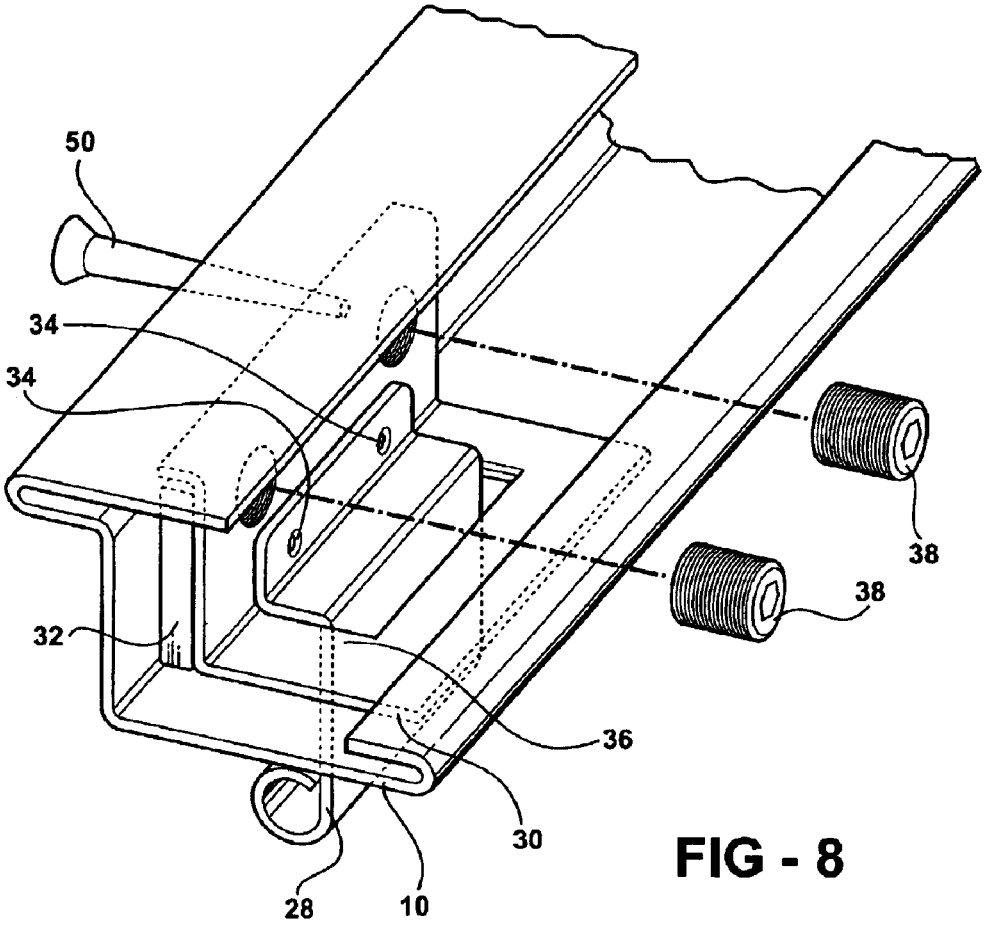
FIG. 8 is a fragmented perspective view of the frame having a hinge disposed therein.

In the frame profile, as seen in FIG. 8, seats are provided to function in four ways. The functions include:

1. receiving a hinge 28 of a bearing fixed part;

2. allowing a fixed joint of a support 30, named "bifort";

3. providing a box 32 in the coupling, as if the shaped frame 10, that is an opened profile, is twisted in such a way to become box-type, thus stiff;

4. by this seat it is possible to relieve load forces directly from the frame to the counterframe in the wall.

Figure 9:
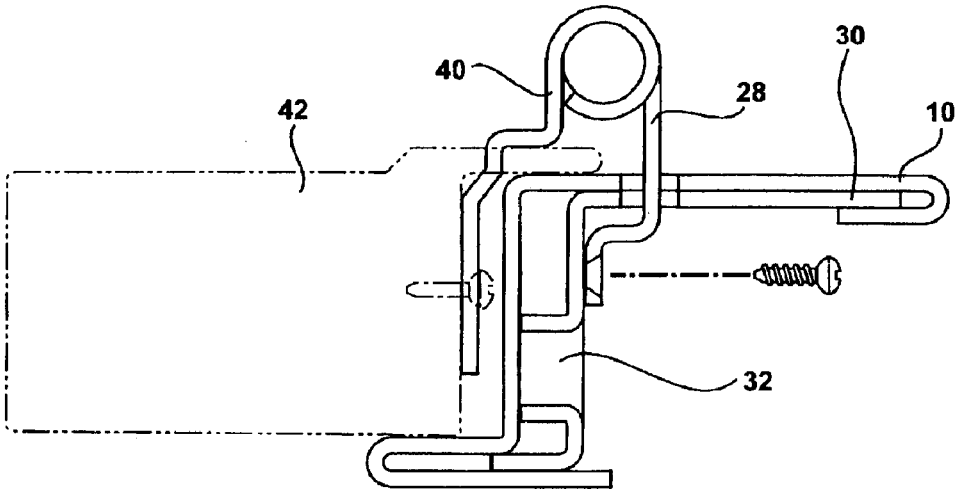
FIG. 9 is a side view of the frame and hinge of FIG. 6.

FIG. 8 represents the four function system from inside. It is possible to see both the frame 10, the support 30, and the hinge 28 overlapped. Locking screws (not shown) are inserted within two holes 34 of the hinge 28. These screws, due to the shapes of the frame 10, the hinge 28, and the support 30, provide the four functions totally blocking the assembly without constraining the frame 10 and only constraining the support 30. In fact, hinge 28 cannot slide due to tooth 36. The support 30 cannot slide because it constrains the hinge 28 and is bucked by the frame 10 such that it cannot twist. Creating the box 32, pressure elements 38 adjust the installation spaces in the counterframe. The counterpart of the hinge 28 is screwed in the wing posts. FIG. 9 represents the section, summarizing FIG. 8 in combination with the other hinge 40 and the wing where the wing 42 is already hinged with the four functions joint.

Figure 10:
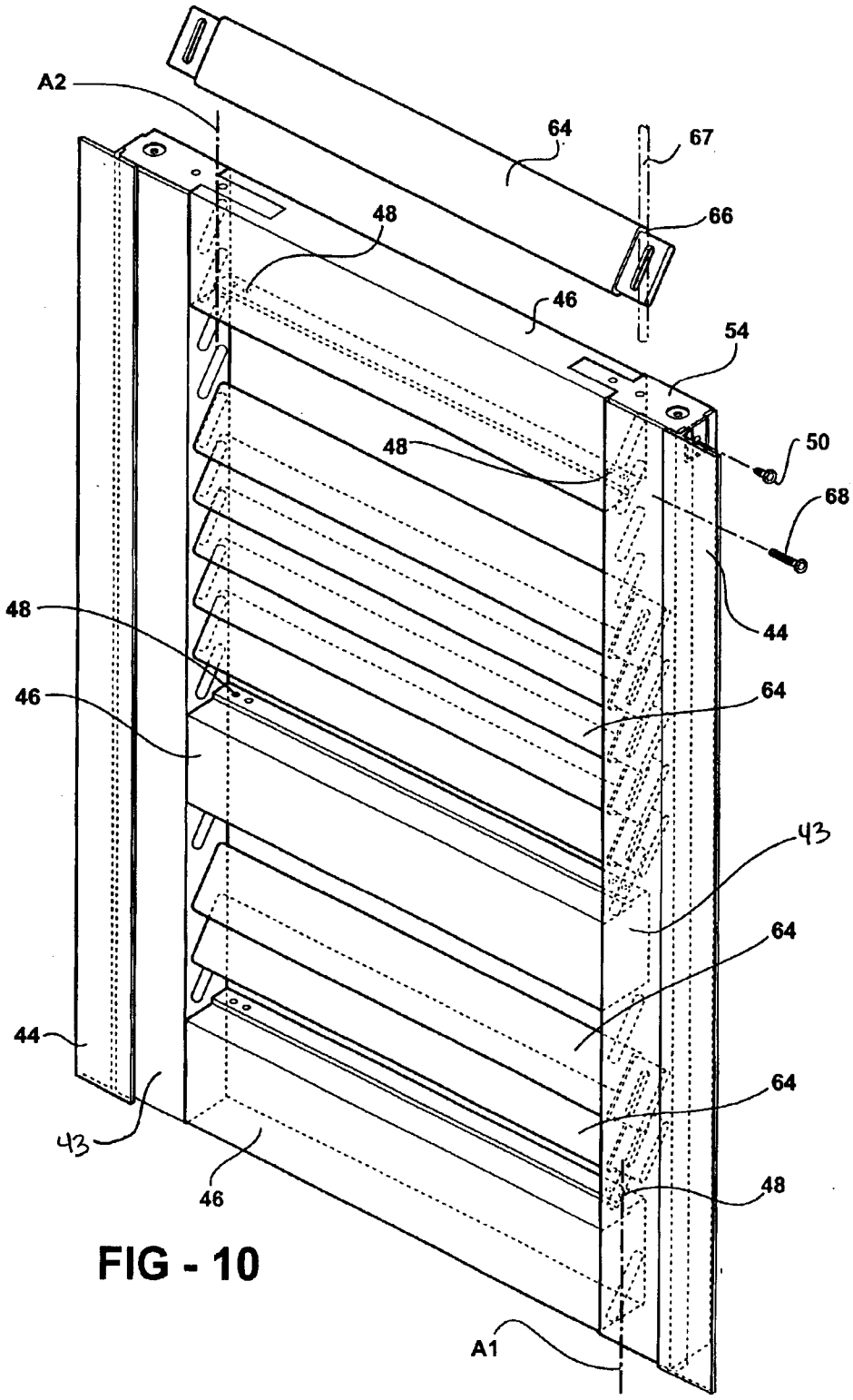
FIG. 10 is a perspective view of a partially assembled blind assembly in accordance with the subject invention having a pair of vertical elements and three transverse elements.

FIG. 4 represents the typical wings in an exploded view and FIG. 10 represents the typical wing already assembled. It is possible to see the slotted vertical elements 43, the characteristic offset lugs 44 of the vertical elements 43 extending in a vertical direction and not in a horizontal direction. As shown in FIG. 4, a handle and locking mechanism may be incorporated into the vertical elements 43 as is known in the art.

Structures of the present invention include the horizontal transverse elements 46. In the Figure it is possible to note that the use of the traverse elements 46 is the same at the top and at the bottom, but in the upper part it is assembled inverted with respect to the base. The inversion is essential to be able to cover the assembling screws 50 and compliment the inclination of the slats. In fact, with the shape of the transverse elements 46, the part that can be seen is the outer side, and the screws 50 are on the inner side.

As shown in the alternative embodiment of FIG. 5, the vertical portions of the frame 10 can have the slots to receive the slats 64; thereby, eliminating the need for vertical elements 43. The transverse elements 46 can also be eliminated. The removal of the vertical elements 43 and the transverse elements 46 simplifies the design of the blind assembly 5.

Figure 11:
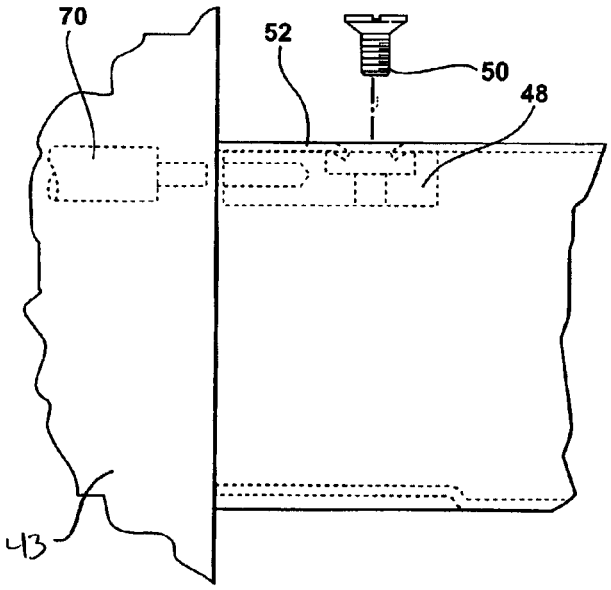
FIG. 11 is a side view of a transverse element being mounted to a vertical element in accordance with the subject invention.
Figure 12:
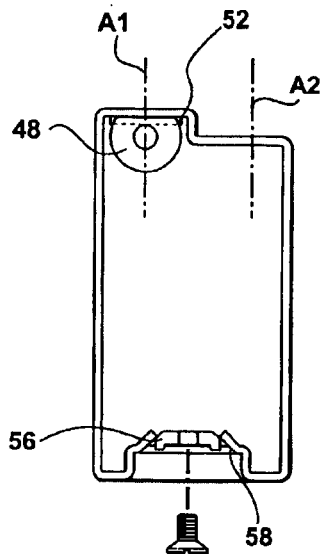
FIG. 12 is a end view of the transverse element.

Referring back to the preferred embodiment, mounting blocks 48 are illustrated in other figures, but they are described with specificity in FIGS. 11 and 12. As it can be noted, mounting blocks 48 include a tooth 52 that enters the thickness of the already breached horizontal element 46, so that, when the screw 50 is tightened, it interlocks the blocks 48 in such a way as to be integral with the corresponding opening in element 46. This relieves the torsion force in the opening and not in the screw 50.

It is obvious that the mounting blocks 48 can be applied both in the axis position A1 and in the axis position A2 of FIGS. 10, 11, and 12. In fact, as illustrated in FIG. 10, mounting blocks in the upper transverse element are placed along the A2 axis, while in the mounting blocks in the bottom transverse element are placed along the A1 axis. This solution conceals the tightening system from the ill-intentioned person who is not able to reach them from outside.

In the opposed part of the profile, a partial drawing is created wherein a bracket 54 is housed for the coupling between the vertical slotted elements 43, that are partially drawn, and elements 46.

Characteristic of the elements 46 is that, as it can be seen from the Figures, the profile is not welded. Therefore, it is an open profile that will be blocked and stiffened by the coupling of the bracket 54 and bridge nuts 56, that can be better observed in FIG. 13.

Nuts 56 sit within a seat 58 provided in the elements 46. The seats hold the nuts 56 in place while attaching the brackets 54 to the profiles. This is necessary because the brackets eliminate the possibility of manually securing the nuts during installation.

The last feature is indispensable since, without the same, it would be impossible to attach the brackets 54 to the profiles retaining the nuts 56 inside without the possibility of reaching the same.

The joint between the profiles has been conceived in this way since all the steel profiles when cut and assembled, always have large tolerances.

Thus, each attempt to assemble them is never quite the same to the earlier attempts. Therefore, using the seats 58, that house the bridge nuts 56 in all the outer corners of the wing permits accurate assembly of the transverse elements 46 and the vertical slotted elements 43. So that each time the corner is tightened with the bracket 54 and the nuts 56, a perfect mechanical seal is obtained independently from any manufacturing defects of the profiles.

Figure 14:
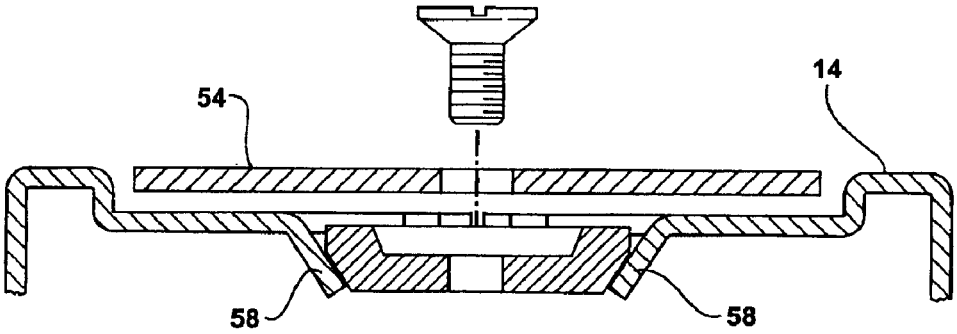
FIG. 14 is a fragmentary sectional view of the transverse element.

In FIG. 14, the mechanical effect of the bridge nut 56 is illustrated. The section has the tightening plane with drawing and sloped planes of the nut 56 with four sides; respectively, two inner sides and two outer sides.

Figure 13:
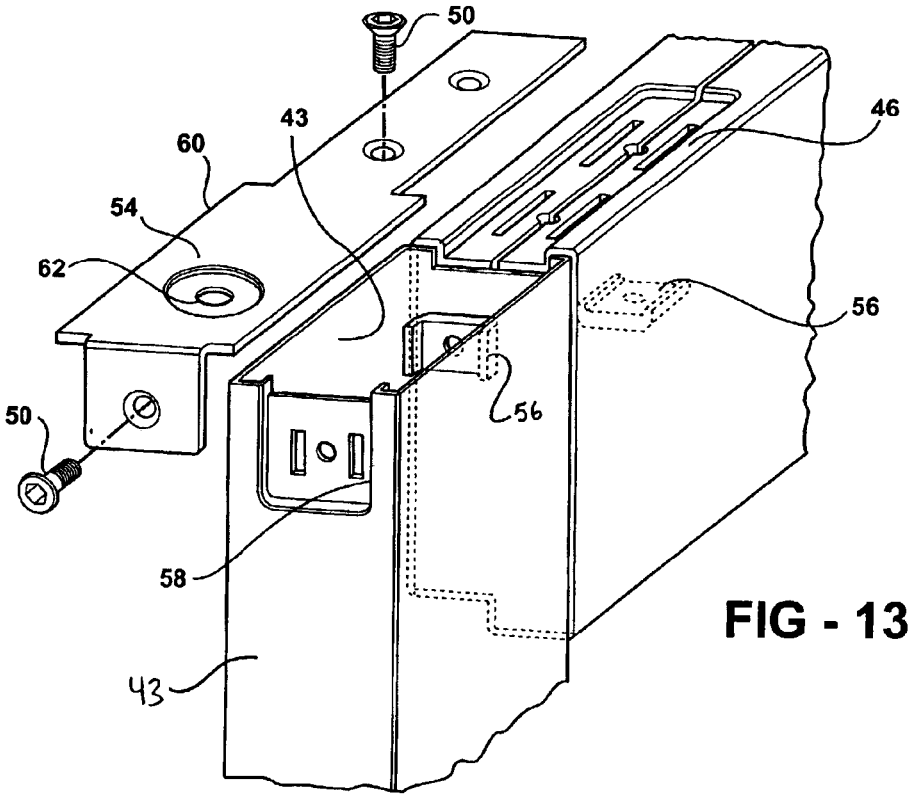
FIG. 13 is perspective view of a transverse element being mounted to a vertical element in accordance with the subject invention.

Due to the effect of the tightening of the screws, they approach the edges and of the transverse elements 46 (FIGS. 13 and 14), while they are held in the vertical seats (FIG. 13).

In this way, transverse elements 46 take the rigidity of the anti-sloping tubular element as an in situ correction. In the mechanical field this effect is really important, mainly for casings, because the two wings of the casing to be closed require a perfect alignment, generally impossible to obtain. Reasons for this include the angled position of the two edges that never are parallel each other, and to the already mentioned manufacturing imperfections of the two profiles. With the open elements 46, the correction is obtained because the edges and can slide in such a way to conform to the vertical elements 43 with the contact planes. This operation is created by the nut seat 58 and by the tightening of the screws 50, shown in FIG. 13. In FIG. 13, bracket 54 is shaped to attach both the transverse element 46 and the vertical element 43. In this way, bracket 54 can maintain a perfect alignment of the same profiles since the wide body 60 of the bracket fixes in the vertical element 43. The drawn hole 62 is provided in the bracket 54 for the passage of the sliding bar (not shown), while three holes with the nuts 56 already fixed in the seats 58. The assembly bracket 54, nuts 56 and seats 58 are thus integral, being very important for the attachment of the corner wing joint.

FIG. 14 illustrates seats 58 retaining the nut 56 in a tightened position, without the screw, before being put under pulling conditions.

Figure 15:
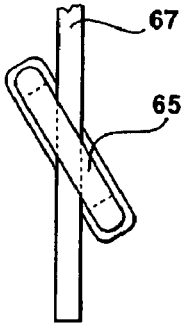
FIG. 15 is an end view of a slat with a tie rod extending therethrough.
Figure 16:
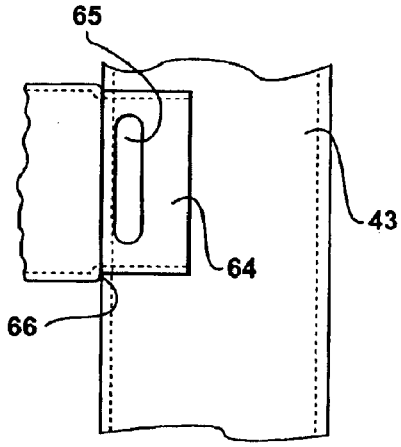
FIG. 16 is a fragmented top view of a slat.
Figure 17:
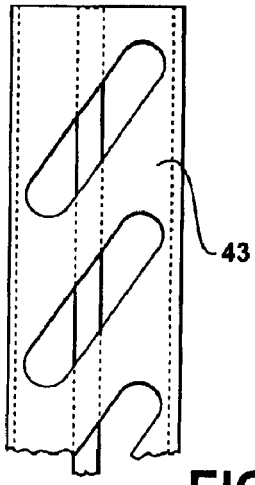
FIG. 17 is a fragmented interior view of a vertical element.

The use of the nuts 56 is consolidated and used also with closed profiles, provided that a perfect execution of the constructive tolerances is ensured, said tolerance being obtained well working in the drawing of the profiles. FIGS. 15–17 show the working of the slat 64, i.e., in the oval shape that will be inserted in the vertical element 43. An opening 65 is provided in the end portion of the width passing through the two walls of the slat 64. The installed slat 64 has an angle of 27° with respect to a support wall in the vertical element 43. A square rod 67 may be inserted therein, passing through the openings 65 in the slats 64.

Square rod 67 can also be a round rod, even if the square rod 67 works better. However, two systems can be interchangeable. The oval slat 64, once introduced within the vertical slotted element 43 abuts against the wall with its tapered neck 66 and cannot proceed beyond that point. Thus, introducing the square rod 67 into the opening 65, the locking of the square rod 67, and the wall of the slotted vertical tubular element 43 provide the bucking.

In FIG. 10, the assembly of the oval slats 64 with the slotted vertical elements 43 can be seen that altogether create the wing that is blocked by the insertion of the square or oval rods 67 profiles, and the tension along the mounting blocks created by bolt 68 and by the use of the bracket 54 with its nuts 56.

Figure 19:
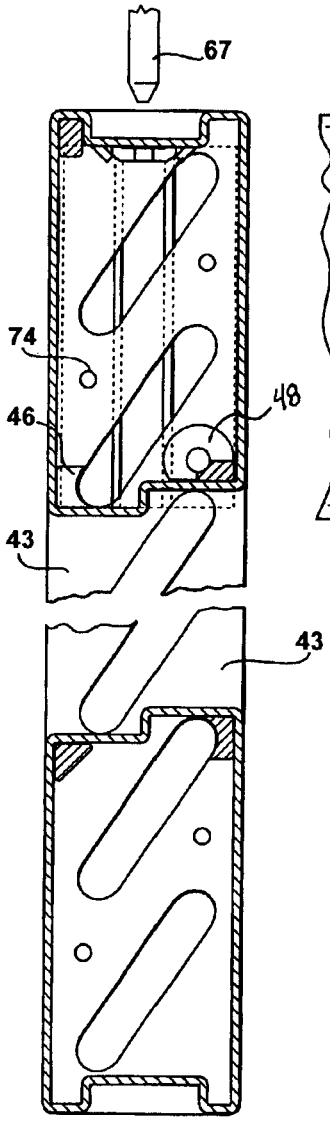
FIG. 19 is a fragmented partially cross-sectional interior view of a vertical element with a pair of transverse elements mounted thereto.
Figure 18:
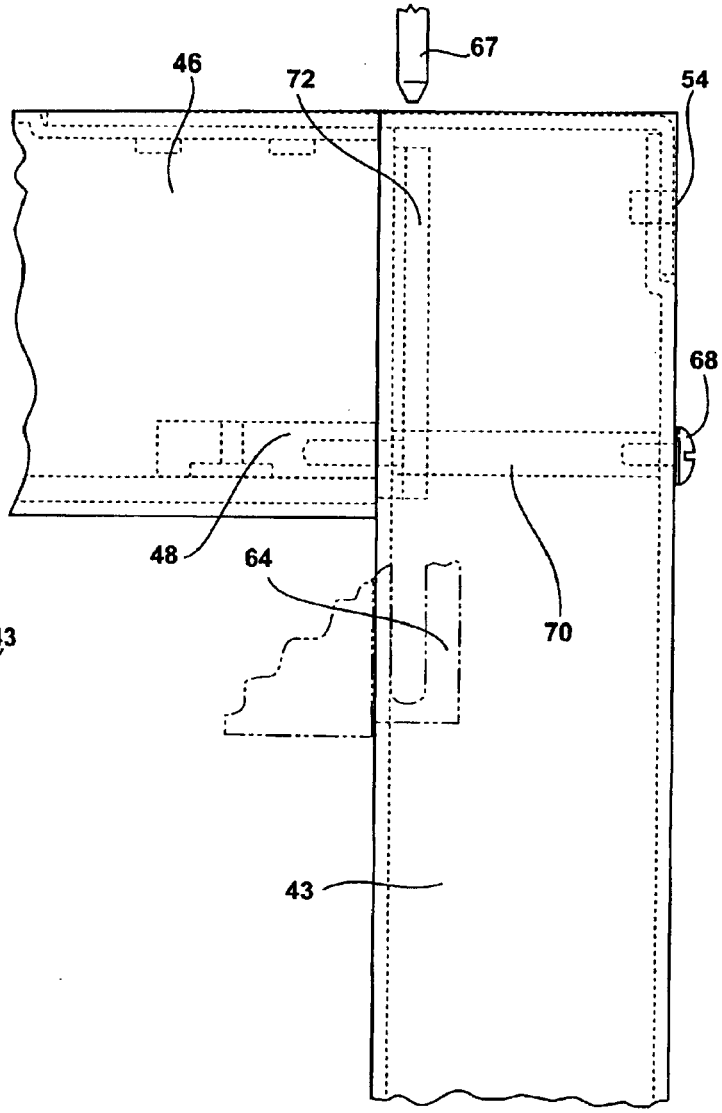
FIG. 18 is a fragmentary side view of a transverse element mounted to a vertical element.
Figure 20:
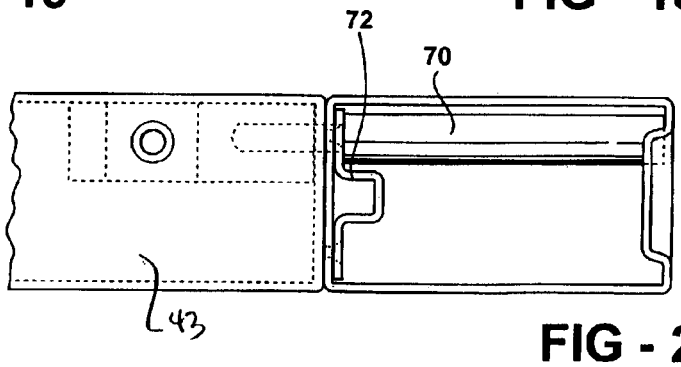
FIG. 20 is a partially cross-sectional top view of a transverse element mounted to a vertical element.

All the above is not in any case sufficient to give an attitude such that all the wing can be said rigid, without any tendency to move some alignment. But since the alignments must not move at all, the system provides that when the transverse elements 46 and the vertical slotted elements 43 meet, a particular bucking abutment is created. FIGS. 18–20 illustrate the support and meeting plane of the slotted vertical element 43 on that side of the slots. To better understand the Figure as it can be seen, the slotted vertical elements are flush with respect to the section of the horizontal transverse elements 46 in such a way that in case one pulls the tie rod 70 in the mounting blocks 48, the joints block without any possibility of moving. Since the bucking abutments creates an out of plane condition on the tie rod 70 side, tension would not be correct; furthermore, slots, would create some empty sections as in the case of the bottom part, where the passage of the tie rod 70 occurs. Therefore, the shaped plate 72 is provided, that is put within the slotted vertical element 43 restoring the resting base of the tie rods. Plate 72 is fixed in the holes 74, always on the side opposite with respect to the tie rod, provided with tearing rivet, in such a way that when the square rod 67 passes through the slat 64, the slat is in the position and the tie rods 70 can be put under tension, with the further function of blocking the square rods 67. Thus the entire joint is tightened on a ribbed insert base with round or square rods 67 participating to support the joint.

Tie rod 70 is a scaling bolt with a head having the same thickness as the tubular vertical element 43, the object being that of providing a grip with the transverse elements 46 but maintaining an orthogonal alignment between the tubular vertical element 43 and the base of the pre-holed wall. In all cases where the tubular vertical element 43 is very big and it is desired to join the wall beside the bracket 54 also on the head of the sealing bolt, the bolt 68 is tightened, said bolt 68 having a threading smaller than the coupling hexagon of the tie rod 70 in the wall. The central transverse element 46 has its shape shown in FIG. 10, and it can be seen reentering base allowing the oval slat 64 to completely occupy its seat and to give an aesthetical aspect to the part having the same dimension of the bottom part or base.

Figure 21:
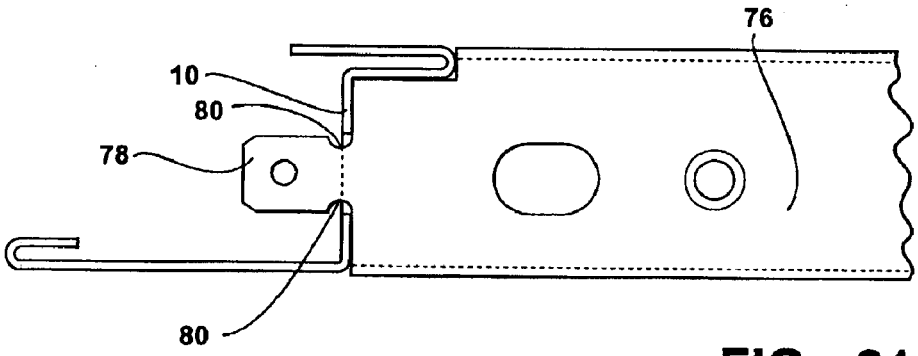
FIG. 21 is a bottom view of another portion of the frame.
Figure 22:
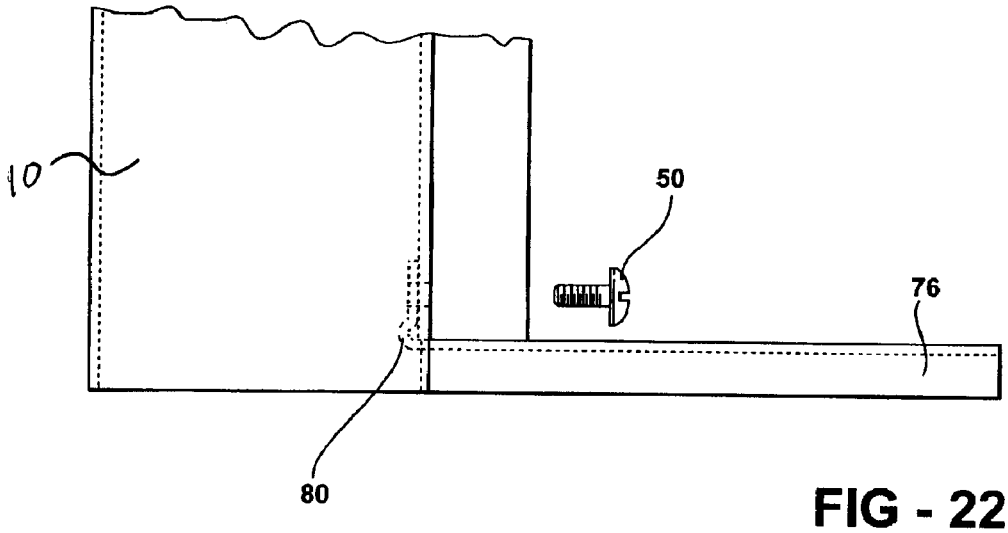
FIG. 22 is a side view of the frame portion of FIG. 19.
Figure 23:
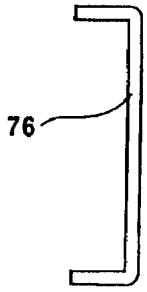
FIG. 23 is a end view of the frame portion of FIG. 19.

Frame 10 is shown in FIG. 6, it can be closed on all the four comers, but in cases where it is not possible to make it, as in the stamping planes and in some windows, a closure 76 with the transverse element 46 is provided, without a square element, but instead with a U shaped transverse profile, see FIGS. 21–23, as it can be seen from the left side the closure 76 is shaped to provide a deformable ear 78 with a hole that secures the screw, said ear 78, as it can be seen, passing through the frame 10 within the groove suitably created and during the blocking it is folded upward, deformation occurring in the relieved point 80, as it can be seen from FIG. 22, already folded, tapping screw 50 blocking the whole within the seat. The profile is holed before its use, to receive the key locking sliding bars and the anchoring screw in the stamping plane, as well as water discharges, etc.

As described in the introduction of the presentation of the state of the art, it mentions gaps.

Figure 24:
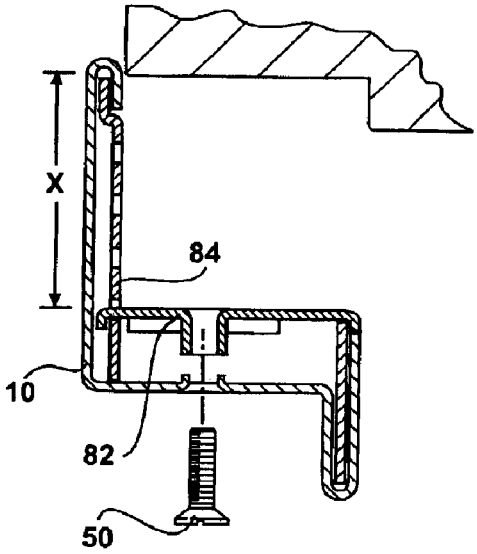
FIG. 24 is a cross-sectional end view of the frame being mounted to a structure.
Figure 25:
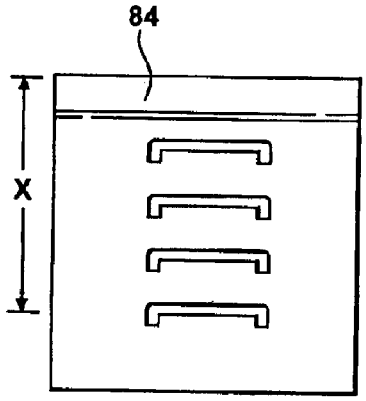
FIG. 25 is a front view of a position plate.

Since "Advanced Siver" system does not provide two C shaped profiles (variable end) because they are not suitable to total prefabrication, it is necessary to solve the problem in a different way. The solution has been individuated transferring the problem of the variable terminal to the frame 10, and precisely, in the following way, see FIG. 24, the upper transverse portion of the frame 10, with a butterfly element 82 and a four position plate 84 are provided. The transverse portion is represented in a descriptive and not limiting way. In FIG. 24, a section of the butterfly element 82 is installed in the lowest point of the plate element 84, the four positions represent a series of spaces, representing the slot pitch of the slotted vertical elements 43. The base profile of transverse element 46 is always the same and cannot be modified. In fact, if the profile could rise until it was under the slot, if the measure of the slotted element is the same it would be necessary to lower the profile of the element 46 of a length corresponding to the space; but in this way, the upper plane of the transverse element 46 would go in the point and the sectioned slot would be half inside and half outside, and thus it could not occupy a whole profile, thus all the measures exceeding a pitch are compensated by the butterfly element 82. Vertical elements 43 are thus cut at 90° angles, respecting the whole slot, that differs from the cut of few millimeters, always the same, and reducing the bottom of the preceding slot, the same applying for the bottom part of the element 43, in this way we would have posts with fixed pitch slots, always complete slots, both outside the sections occupied by the profiles and within said profiles.

In the Figure it is put into evidence the space that must be recovered at the maximum, to have available another useful slot.

It is obvious that in this way all the possible cuts in the slots of the elements 43 are limited and always multiple, starting from the minimum measure that will correspond to the space occupied by two transverse elements 46 plus the space of a slot, so that if the transverse elements 46 are 85 and 92 and the slat 42.5, we will have the measure of 85+92+42.5=(219,5), the following measure will be 219,5+42,5=(219,5+42,5)=262. Thus, all the possible measures will be progressively 262+42,5 etc., all the intermediate spaces between a possible measure and the following one will always be lower than the pitch and recovered by the butterfly element 82. In FIGS. 24 and 23, said space is represented in by X, the example with millimeters is only representative, but not limiting, so that the specification is continued in the same way, and it is assumed that X=42,5. In on embodiment, the device divides said measure into four spaces, but the number of spaces is not critical. In the example, four spaces from 1 to 4 are sufficient. Butterfly element 82 is positioned in space 1, see FIG. 24, and is blocked by screw 50, engaging with its seat, thus creating the grip point, pressure coupling the strap sliding all along the frame 10.

Figure 26:
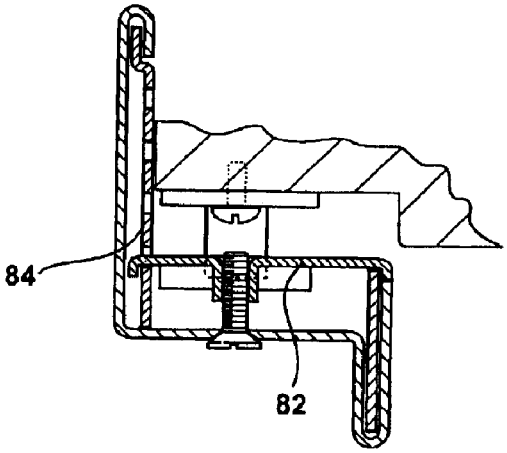
FIG. 26 is a cross-sectional end view of the frame mounted to a structure.
Figure 27:
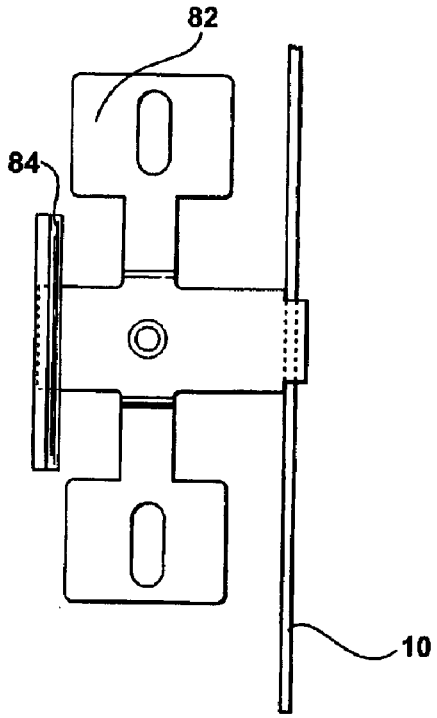
FIG. 27 is a top view of a butterfly element.
Figure 28:
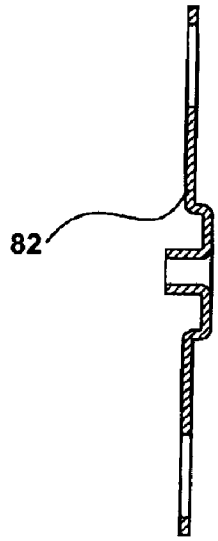
FIG. 28 is a cross-sectional side view of the butterfly element.
Figure 29:
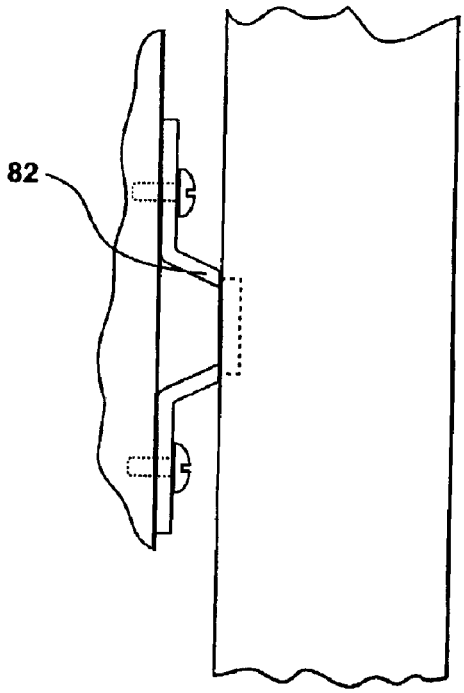
FIG. 29 is a side view of the butterfly element mounted to a structure.

At the opposite, butterfly element 82 grasps in the position of the position plate 84 in the lower space 1; in this way the starting point has been created for the first quarter of the four quarters of the pitch in case we should recover at most ¼of the pitch, in case we should recover ¾ of the pitch, we would arrive to install the butterfly element 82 within the position plate element 84 in space 2 employing strap 2, and so on until the last quarter. Therefore, butterfly element 82 can be deformed, see FIG. 26, from a position to the following one in order to attach to the upper transverse architrave with the screw 50. If we consider FIG. 24, butterfly element 82 can deform until the maximum plane from space 1, sliding, with deformation, all along the space 1, so that we will have the architrave plane, see FIG. 26. If we observe FIGS. 27 and 28, the portion destined to the deformation can be noted, i.e., two necks of the butterfly element 82 the slots are suitably provided to allow to the butterfly element 82 to slide while the screw tightens and pulls upward the deformed base point, making the device suitable to the useful space of the first of the four quarters of the pitch. FIG. 29 shows the butterfly of FIGS. 27 and 26, already deformed in the first quarter in position 2 being fixed in 1. The device can be fixed in the central point of the transverse frame 10 by screws 50 that are as longer as more the position of the butterfly is moved upward from 1° to 4° place, thus we will have also four measures of straps, one for each fixing position. All the above device is sufficiently rigid, since the straps are fixed within the folding of the frame, see FIGS. 24 and 26, and position plate 84 in fold 86.

Prefabricated steel blind realized by the "Advanced Siver" system can provide an inexpensive armored blind.

What is claimed is:

1. A blind assembly comprising:

a pair of vertical elements each having a top and bottom and a plurality of slots formed therein;

an upper transverse element engaging the tops of the vertical elements;

a lower transverse element engaging the bottoms of the vertical elements;

a plurality of slats engaging the slots of the vertical elements and extending substantially parallel with the upper and lower transverse elements; and a mounting arrangement interlocking the upper transverse element to the tops of the vertical elements or the lower transverse element to the bottoms of the vertical elements, and including at least one bracket that attaches to orthogonal surfaces located on the transverse element and the vertical elements.

2. An assembly as set forth in claim 1 wherein the mounting arrangement further includes at least one nut engaging a seat on at least one of the vertical and transverse elements with a screw passing through the bracket, and the vertical element, or the transverse element to engage the nut.

3. An assembly as set fourth in claim 2 wherein the mounting arrangement further includes a plurality of nuts engaging seats on the vertical and transverse elements with screws passing through the bracket, the vertical element, and transverse elements to engage the nuts which fixedly couples the vertical element to the transverse element.

4. An assembly as set forth in claim 1 wherein the mounting arrangement further comprises a mounting block secured within at least one of the upper and lower transverse elements.

5. An assembly as set forth in claim 4 wherein the mounting arrangement further includes a tie rod that attaches each of the upper and lower transverse elements to the vertical elements.

6. An assembly as set forth in claim 5 wherein the mounting arrangement further includes a bolt that passes through each of the vertical elements and engages tie rods.

7. An assembly as set forth in claim 1 wherein each of the slats includes a tapered neck at the distal ends with the neck extending through the slots of the vertical elements.

8. An assembly as set forth in claim 7 wherein each of tapered necks includes an opening with the openings of the slats aligning when the slats are installed within the vertical elements.

9. An assembly as set forth in claim 8 wherein the mounting arrangement further comprises a rod passing through the aligned openings to fixedly secure the slats to the vertical elements.

10. An assembly as set forth in claim 1 further including a frame having an upper transverse portion and a pair of vertical portions for substantially surrounding the vertical and transverse elements.

11. An assembly as set forth in claim 10 wherein the vertical elements and the transverse elements form a blind that is rotatably mounted to the frame with at least one hinge.

12. An assembly as set forth in claim 10 further including a butterfly element and a position plate mounted to the upper transverse portion of the frame where the butterfly element is positioned along the plate to provide a variable mounting surface for the frame.

13. An assembly as set forth in claim 10 further including a square element disposed within each distal end of the upper transverse portion that engages the vertical portions and secures the vertical portion to the transverse portion.

14. An assembly as set forth in claim 13 further including at least one tie rod that joins the upper transverse portion and the vertical portions and engages a hole within a square element.

15. An assembly as set forth in claim 14 further including a base mounted inside the upper traverse portion that secures the tie rod by engaging the tie rod as it travels through the base into the vertical portion.

16. An assembly as set forth in claim 10 wherein vertical elements are further defined as the vertical portions of the frame such that the vertical portions of the frame included slots for receiving slats.

17. An assembly as set forth in claim 16 wherein mounting arrangement is further defined as a square element disposed within each distal end of upper transverse portion that engages vertical portions and attaches the vertical portions to the transverse portion.

18. An assembly as set forth in claim 17 wherein mounting arrangement further includes at least one tie rod that joins the upper transverse portion and the vertical portion by engaging a hole within square element.

* * * * *

UNITED STATES PATENT AND TRADEMARK OFFICE

CERTIFICATE OF CORRECTION

PATENT NO. : 7,036,279 B2
DATED : May 2, 2006
INVENTOR(S) : Gualtiero Crozzoli

It is certified that error appears in the above-identified patent and that said Letters Patent is hereby corrected as shown below:

Column 9,
Line 24, "portion" should be -- portions --.

Signed and Sealed this

Thirteenth Day of June, 2006

JON W. DUDAS
*Director of the United States Patent and Trademark Office*